US005246126A

United States Patent [19]

Lewis, Jr.

[11] Patent Number: 5,246,126

[45] Date of Patent: Sep. 21, 1993

[54] OIL CONTAINER

[76] Inventor: John I. Lewis, Jr., Rt. 4, Box 324, Spring Lake, N.C. 28390

[21] Appl. No.: 976,563

[22] Filed: Nov. 16, 1992

[51] Int. Cl.[5] ..... B65D 51/24

[52] U.S. Cl. ..... 215/303; 215/232; 215/305

[58] Field of Search ..... 215/232, 253, 255, 257, 215/295, 303, 305; 220/262, 258, 359

[56] References Cited

U.S. PATENT DOCUMENTS

| | | | |
|---|---|---|---|
| 4,739,892 | 4/1988 | Tudek | 215/232 |
| 4,863,047 | 9/1989 | Crow | 215/32 |
| 4,869,383 | 9/1989 | Bahr et al. | 215/232 |
| 4,872,571 | 10/1989 | Crecelius et al. | 215/232 |
| 5,121,845 | 6/1992 | Blanchard | 215/232 |
| 5,156,286 | 10/1992 | Piccard | 215/232 |

*Primary Examiner*—Allan N. Shoap
*Assistant Examiner*—Nova Stucker
*Attorney, Agent, or Firm*—Leon Gilden

[57] ABSTRACT

An oil container includes a container structure having a spout mounted to a top wall of the container, with the spout tangentially aligned to a forward wall, a groove directed into the spout, with a pull string directed through the groove, the string including a first end secured to a slot slidably mounted to a second end wall of the container, with a second end of the pull string mounted to a foil seal over the spout. In this manner, displacement of the slide along the second end wall of the container displaces the foil seal permitting fluid flow from the container when in an inverted orientation preventing spillage from the container.

3 Claims, 4 Drawing Sheets

OIL CONTAINER

BACKGROUND OF THE INVENTION

1. Field of the Invention

The field of invention relates to container structure, and more particularly pertains to a new and improved oil container wherein the same permits fluid flow from the container in a controlled relationship when the container is in an inverted orientation.

2. Description of the Prior Art

In the filling and replenishment of lubrication fluid within an internal combustion engine, the spout of such container structure is removed whereupon inverting the container, spillage from the container occurs due to a need for properly orienting the spout of the container within a fluid receiving opening relative to the internal combustion engine. The instant invention attempts to overcome deficiencies of the prior art by providing for a convenient spill control and fluid flow container structure preventing fluid flow from the container prior to the displacement of a foil seal relative to the spout of the container preventing spillage from the container in use. Prior art fluid flow container structure is indicated in the U.S. Pat. No. 4,884,600; 4,976,379; 5,042,698; 4,842,152; and 4,863,047.

Accordingly, the instant invention overcomes deficiencies of the prior art by providing for a seal removal structure relative to the container in a manner not addressed by the prior art and in this respect, the present invention substantially fulfills this need.

SUMMARY OF THE INVENTION

In view of the foregoing disadvantages inherent in the known types of oil container structure now present in the prior art, the present invention provides an oil container wherein the same permits remote removal of a spout seal prior to fluid flow therefrom. As such, the general purpose of the present invention, which will be describe subsequently in greater detail, is to provide a new and improved oil container which has all the advantages of the prior art oil containers and none of the disadvantages.

To attain this, the present invention provides an oil container including a container structure having a spout mounted to a top wall of the container, with the spout tangentially aligned to a forward wall, a groove directed into the spout, with as pull string directed through the groove, the string including a first end secured to a slot slidably mounted to a second end wall of the container, with a second end of the pull string mounted to a foil seal over the spout. In this manner, displacement of the slide along the second end wall of the container displaces the foil seal permitting fluid flow from the container when in an inverted orientation preventing spillage from the container.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved oil container which has all the advantages of the prior art oil container and none of the disadvantages.

It is another object of the present invention to provide a new and improved oil container which may be easily and efficiently manufactured and marketed.

It is a further object of the present invention to provide a new and improved oil container which is of a durable and reliable construction.

An even further object of the present invention is to provide a new and improved oil container which is susceptible of a low cost of manufacture with regard to both materials and labor, and which accordingly is then susceptible of low prices of sale to the consuming public, thereby making such oil containers economically available to the buying public.

Still yet another object of the present invention is to provide a new and improved oil container which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
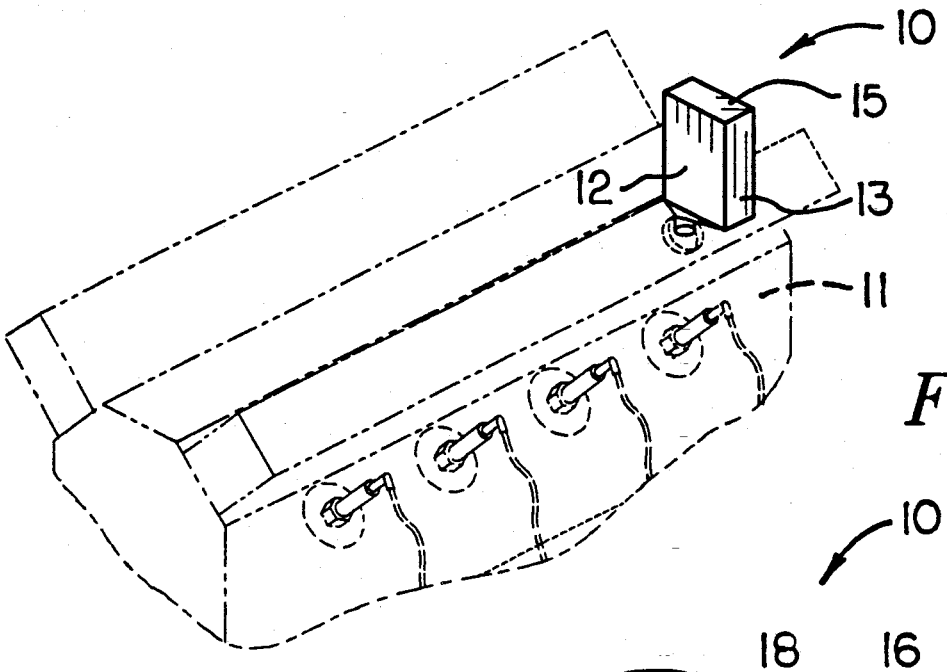
FIG. 1 is an isometric illustration of the invention in use.
Figure 2:
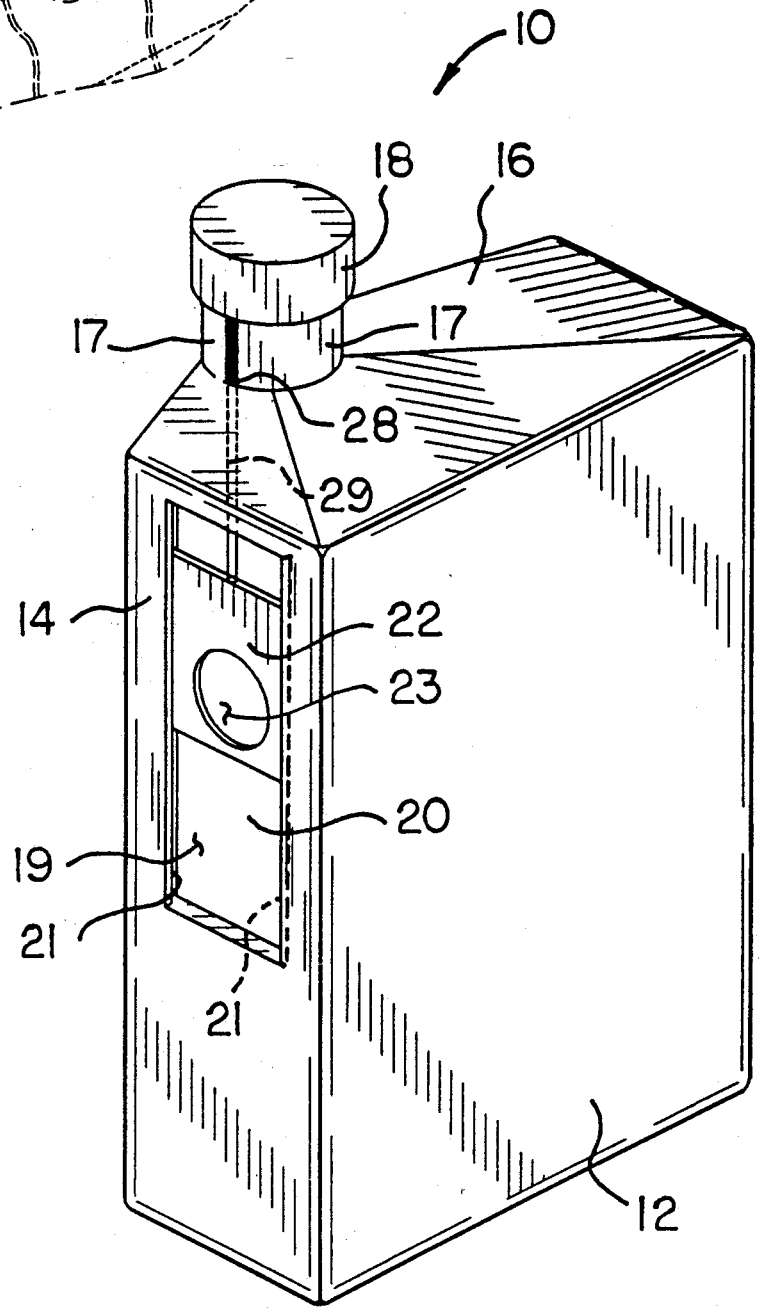
FIG. 2 is an isometric illustration of the invention.
Figure 3:
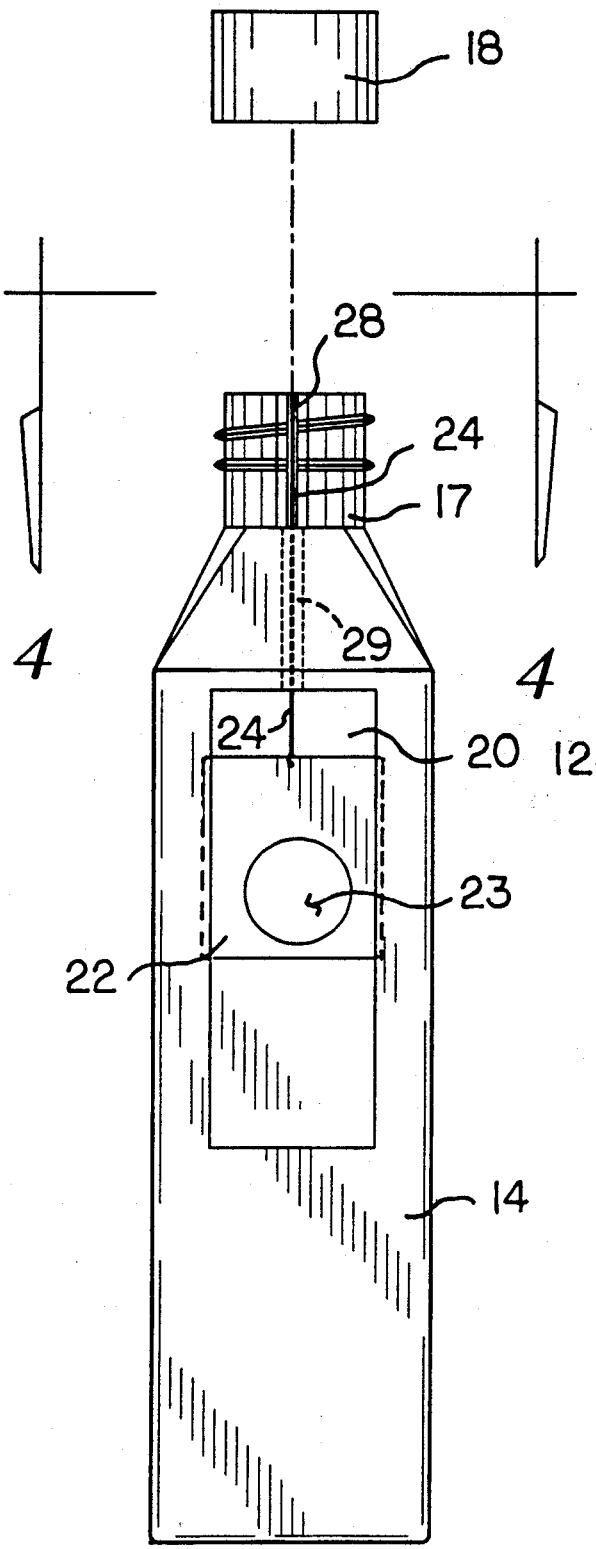
FIG. 3 is an orthographic end view of the invention.

With reference now to the drawings, and in particular to FIGS. 1 to 8 thereof, a new and improved oil container embodying the principles and concepts of the present invention and generally designated by the reference numeral 10 will be described.

Figure 4:
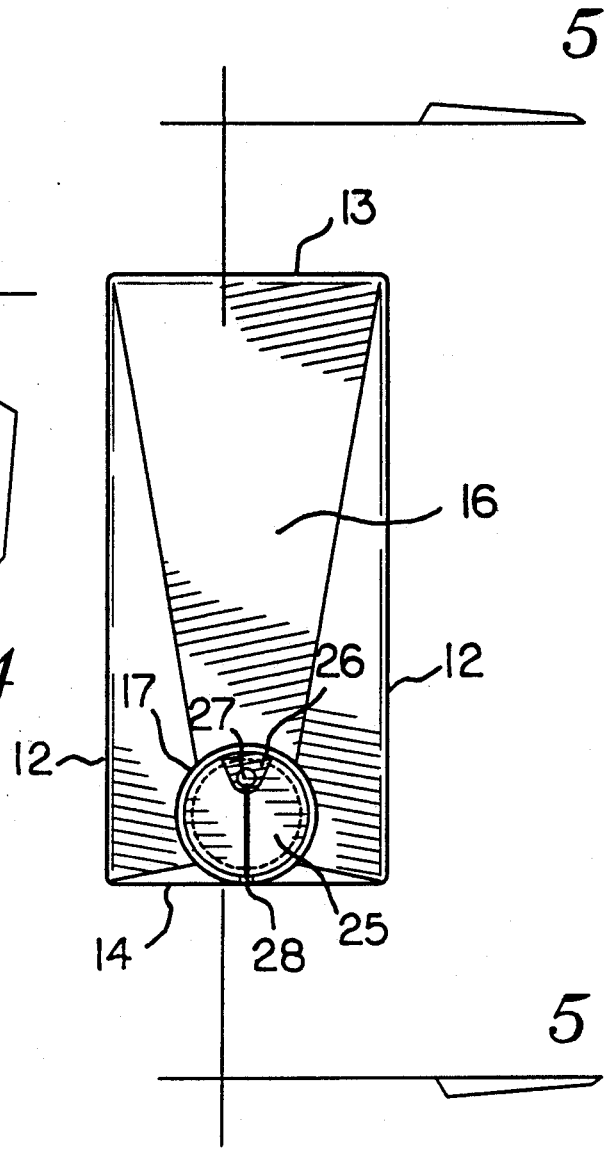
FIG. 4 is an orthographic view, taken along the lines 4—4 of FIG. 3 in the direction indicated by the arrows.
Figure 5:
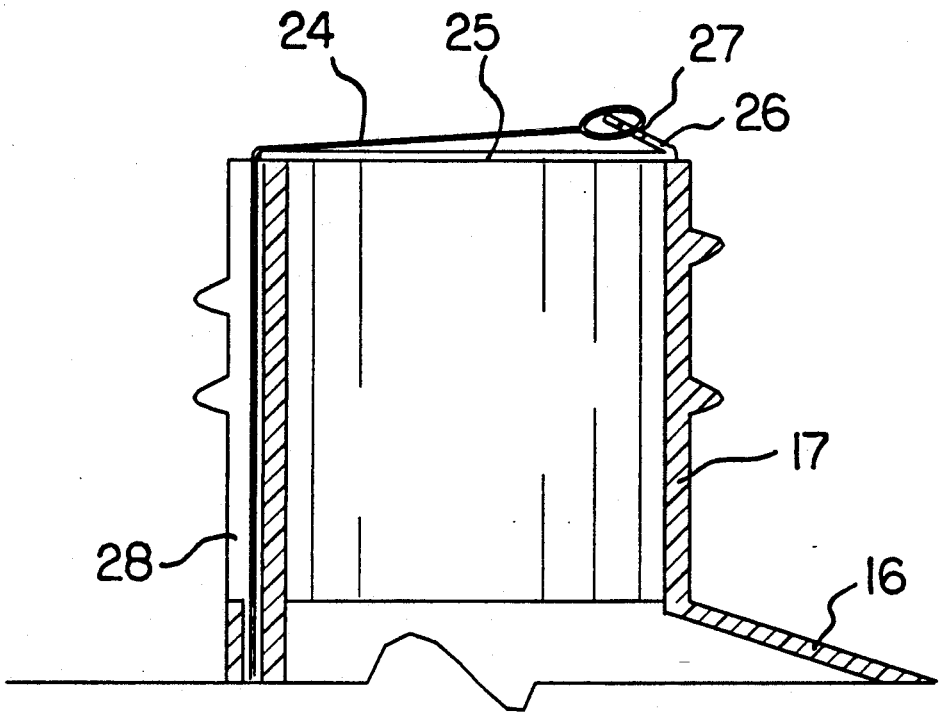
FIG. 5 is an orthographic view, taken along the lines 5—5 of FIG. 4 in the direction indicated by the arrows.
Figure 6:
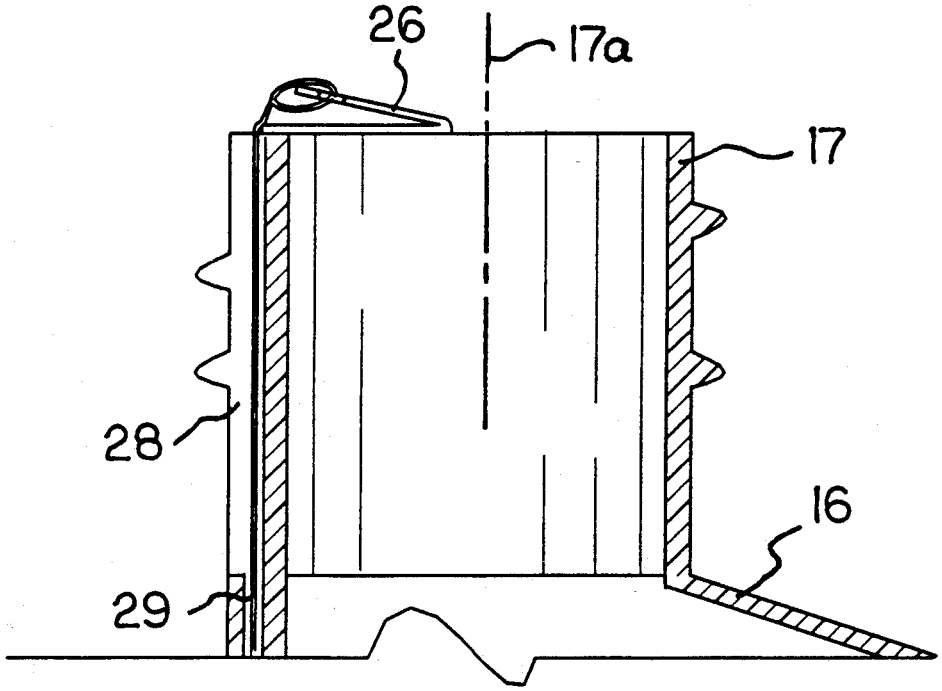
FIG. 6 is an orthographic view of the fluid control seal in a second position effected by displacement of the associated slide plate of the invention.

More specifically, the oil container 10 is arranged for directing fluid therefrom into an associated internal combustion engine 11, as indicated in FIG. 1. Typically, this procedure is effected by the directing of a pouring spout through an opening such as in a valve cover of the internal combustion engine, in a manner known in the prior art. Typically, during inverting of the container, as indicated in FIG. 1, and prior to proper alignment and positioning of the spout within the opening within the internal combustion engine, spillage may be resultant during the inverting process. To this end, the improved oil container 10 of the invention essentially comprises spaced side walls 12 having a bottom wall 15 spaced from a convex top wall 16. First and second end walls 13 and 14 respectively define the interior cavity of the container for having a fluid, such as motor oil, therewithin. The convex top wall 16 includes a pouring spout 17 whose axis 17*a* (see FIG. 5) is substantially parallel to the cylindrical exterior surface of the spout, wherein the spout exterior surface is tangentially aligned with the second end wall 14, in a manner as illustrated in FIG. 4 for example. A spout lid 18 is arranged for threaded securement to the spout and permitting ease of removal of the lid 18 prior to a pouring procedure from the container structure.

The second end wall 14 has a second end wall opening 19 in a spaced relationship relative to a second end wall interior wall 20 parallel to the second end wall 14, and with the second end wall interior wall 20 extending laterally beyond the second end wall 14 to sealingly segregate the second end wall opening 19 from the interior cavity of the container. Spaced parallel guide tracks 21 are oriented between the interior wall 20 and the second end wall 14 between opposed sides of the opening 19, with a slide plate 22 slidably guide within the guide tracks 21, with the slide plate 22 arranged for displacement along the opening 19. A slide plate opening 23 provides finger access for ease of manual grasping of the slide plate 22 for its vertical displacement for an orientation relative to the top wall 16 directed towards the bottom wall 17. The spout 17 is formed with a spout groove 28 that is linearly aligned with the slide plate 22 intersecting the slide plate 22, with the spout groove 28 in communication with a second end wall channel 29 directed through the second end wall, with the second end wall channel 29 directed into the second end wall opening 19. A flexible pull string 24 has a first end secured to an uppermost edge of the slide plate 22, with a second end directed through the second end wall channel 29 and along the spout groove 28. A spout seal 25 is sealingly engaged to overlie the spout opening of the spout 17, wherein the spout seal 25 includes a projecting flange 26 having a projecting flange opening 27. A second end of the pull string 24 is secured to the flange opening 27. The projecting flange 26 is mounted onto the seal 25 in adjacency to the periphery of the spout 17 diametrically opposed to the spout groove 28 in a first position, whereupon displacement of the slide plate 22 within the second end wall opening 19 displaces the projecting flange 26 as well as the spout seal 27 to a second position, with the projecting flange 26 in adjacency to the spout groove 28. During this occurrence, the seal 25 is separated relative to the periphery of the pouring spout 17 permitting fluid flow therefrom. This occurs upon the container being positioned in an inverted orientation, as indicated in FIG. 1, to thereby prevent fluid flow prior to the inversion of the container.

Figure 7:
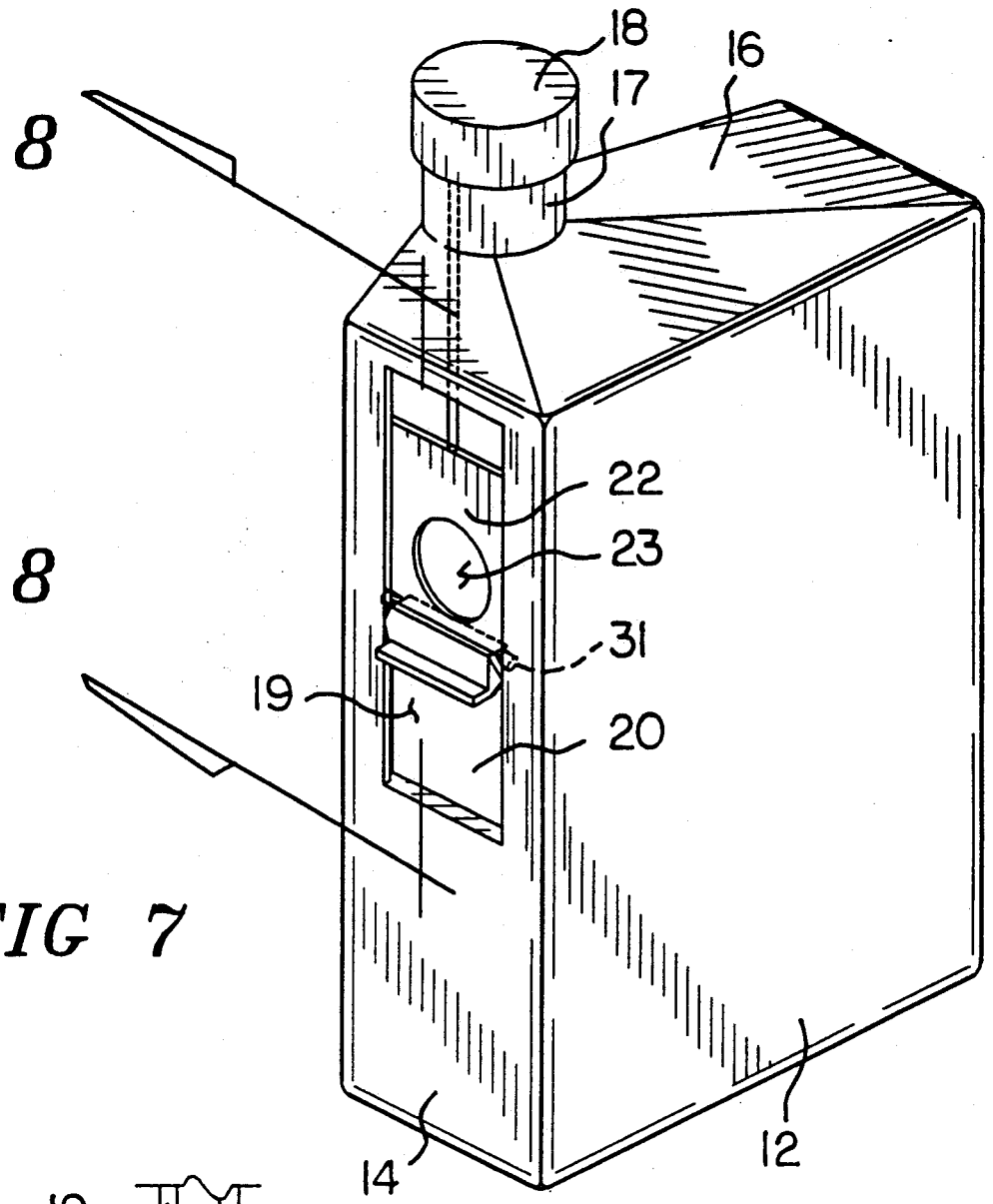
FIG. 7 is an isometric illustration of the invention employing a lock plate structure relative to the slide plate.
Figure 8:
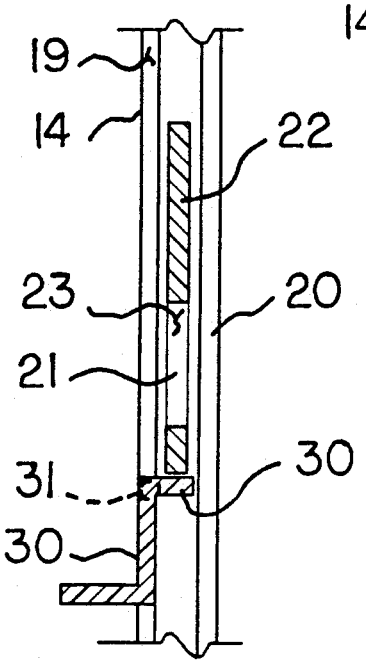
FIG. 8 is an orthographic view, taken along the lines 8—8 of FIG. 7 in the direction indicated by the arrows.

The FIGS. 7 and 8 indicates the organization provided with a lock plate 30 formed with frangible ribs 31 relative to the second end wall 14 within the opening 19. In this manner, inadvertent vertical displacement and sliding of the slide plate 22 within the opening 19 is prevented. The frangible ribs 31 are twisted by pivoting of the lock plate within the opening 19 and permitting removal of the lock plate, wherein as indicated in FIG. 8, the lock plate extends to an orientation below and in adjacency to a lowermost end of the slide plate, whereupon removal of the lock plate removes the abutment ledge 30*a* of the lock plate thereby permitting displacement of the slide plate 22 within the opening 19 between the second end wall 14 and the second end wall interior wall 20.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An oil container, comprising, spaced first and second side walls, a bottom wall, and a top wall, a first end wall and a second end wall, and a spout mounted to the top wall in communication interiorly of the container, with the spout having a spout lid removably mounted relative to the spout, and a spout seal, with the spout having a spout free distal end, with the free distal end including a periphery, and the spout seal mounted to the periphery, the spout seal having a flexible projecting flange, and the projecting flange including a pull string, the pull string extending along an exterior surface of the spout, with the pull string secured to the projecting flange permitting removal of the seal by tensioning of the pull string relative to the projecting flange, and the second end wall includes a second end wall opening directed into the second end wall below the spout, and the second end wall further includes a second end wall interior wall extending laterally beyond the second end wall opening in surrounding relationship relative to the second end wall opening in sealing engagement to an interior surface of the second end wall, and a slide plate slidably mounted between the second end wall interior wall and the second end wall, the spout having a spout groove, the spout groove linearly aligned with the slide plate, and the spout exterior surface tangentially aligned with the second end wall, with the pull string directed along the spout groove, and a second end wall channel directed through the second end wall in communication with the second end wall opening, with the pull string directed through the second end wall channel from the spout groove, and secured to the slide plate with the second end wall opening, whereupon displacement of the slide plate within the second end wall opening displaces the spout seal relative to the spout.

2. An oil container as set forth in claim 1 wherein the projecting flange is mounted adjacent the periphery of the spout diametrically opposed to the spout groove in a first position, with the projecting flange displaced to a second position in adjacency to the spout groove when the slide plate is displaced relative to the second end wall opening between the second end wall and the second end wall interior wall.

3. An oil container as set forth in claim 2 including a lock plate, the lock plate having an abutment flange positioned in adjacency to the slide plate, with the abutment flange oriented between the second end wall and the second end wall interior wall, with the lock plate having at least one frangible connection to the second end wall within the second end wall opening, whereupon removal of the lock plate permits displacement of the slide plate from the first position the second position.

* * * * *